US006147548A

United States Patent [19]

Doyle

[11] Patent Number: 6,147,548

[45] Date of Patent: Nov. 14, 2000

[54] SUB-BANDGAP REFERENCE USING A SWITCHED CAPACITOR AVERAGING CIRCUIT

[75] Inventor: James T. Doyle, Chandler, Ariz.

[73] Assignee: Intel Corporation, Santa Clara, Calif.

[21] Appl. No.: 09/441,629

[22] Filed: Nov. 16, 1999

Related U.S. Application Data

[62] Division of application No. 08/926,649, Sep. 10, 1997, Pat. No. 6,052,020.

[51] Int. Cl.[7] ..... G05F 1/10

[52] U.S. Cl. ..... 327/539; 327/540; 323/313

[58] Field of Search ..... 327/538, 539, 327/540, 541, 543; 323/313, 316

[56] References Cited

U.S. PATENT DOCUMENTS

| | | | |
|---|---|---|---|
| 5,352,972 | 10/1994 | Pernici et al. | 327/539 |
| 5,541,551 | 7/1996 | Brehner et al. | 327/539 |
| 5,568,045 | 10/1996 | Koazechi | 323/324 |
| 5,629,611 | 5/1997 | McIntyre | 323/316 |
| 5,631,600 | 5/1997 | Akioka et al. | 327/546 |
| 5,821,807 | 10/1998 | Brooks | 327/540 |
| 5,867,013 | 2/1999 | Yu | 323/314 |
| 6,031,365 | 2/2000 | Sharpe-Geisler | 323/313 |

OTHER PUBLICATIONS

*Micropower CMOS Temperature Sensor with Digital Output*, Anton Bakker, Johan H. Huijsing; IEEE Journal of Solid–State Circuits, vol. 31, No. 7, Jul. 1996.

*A Low Noise, High Resolution Silicon Temperature Sensor*, Kenneth S. Szajda, Charles G. Sodini, and H. Frederick Bowman, IEEE Journal of Solid–State Circuits, vol. 31, No. 9, Sep. 1996.

*Primary Examiner*—Terry D. Cunningham

*Attorney, Agent, or Firm*—Blakely, Sokoloff, Taylor & Zafman LLP

[57] ABSTRACT

A sub-bandgap reference circuit yielding a reference voltage smaller than the bandgap voltage of silicon. The circuit generates a negative temperature coefficient signal $V_{be}$ and an oppositely tracking (positive temperature coefficient) $\Delta V_{be}$, and takes the average of two signals related to $\Delta V_{be}$-$V_{be}$ to yield a temperature-compensated voltage of one-half the bandgap voltage of silicon. The circuit features an unequal area current mirror feeding the diodes and resistors used to generate the $\Delta V_{be}$-$V_{be}$ signals using low supply voltages (less than 1.5 volts). A standard CMOS implementation provides low power consumption at a supply voltage of only 1 volt with a good temperature coefficient. The averaging circuit may be implemented by a continuous time divider or by using switched capacitor techniques. The loop amplifier used in the $\Delta V_{be}$-$V_{be}$ circuitry operates with low headroom in part due to a n-well biasing scheme that lowers the effective threshold voltage of the p-channel FETs used in the loop amplifier.

3 Claims, 9 Drawing Sheets

SUB-BANDGAP REFERENCE USING A SWITCHED CAPACITOR AVERAGING CIRCUIT

This application is a Divisional of Ser. No. 08/926,649, filed Sep. 10, 1997, now U.S. Pat. No. 6,052,020.

BACKGROUND

The invention relates generally to circuits and devices that produce a precise and stable DC signal, and more specifically, to temperature compensated bandgap reference circuits.

Virtually all systems that manipulate analog, digital or mixed signals, such as analog-to-digital and digital-to-analog converters, rely on at least one reference voltage as a starting point for all other operations in the system. Not only must a reference voltage be reproducible every time the circuit is powered up, the reference voltage must remain relatively unchanged with variations in fabrication process, operating temperature, and supply voltage.

A conventional technique for realizing a reference voltage uses the semiconductor bandgap reference circuit (also known as a bandgap reference). As explained in detail below, a bandgap reference relies on the predictable variation with temperature of the bandgap energy of the underlying semiconductor material. A practical way to obtain the behavior of the bandgap energy of a semiconductor material is to measure the "bandgap voltage" across a forward biased semiconductor P-N junction (diode) device. Although loosely referred to here as a diode, other devices such as transistors are also typically used to obtain the necessary P-N junction. For example, a conventional way to obtain a bandgap voltage is to diode-connect a bipolar junction transistor (BJT) such that the base to emitter voltage drop $V_{be}$ is the voltage that exhibits bandgap behavior.

The term $V_{be}$ historically originated with BJT-based bandgap reference circuits. In the remaining discussion, however, $V_{be}$ is used to refer to any suitable diode-like element that exhibits a diode voltage drop.

FIG. 1 illustrates the extrapolated variation of $V_{be}$ with temperature for two devices having the same emitter current but different current areas (and hence different current densities). If it were possible to generate a voltage that increased proportionally with temperature at the same rate at which $V_{be}$ of a given transistor decreased, then the sum of the two voltages will be constant and equal to the bandgap voltage of approximately 1.205 volts, a physical constant. Therein lies the principle behind a bandgap reference.

A conventional bandgap reference 200 that attempts to implement the above principle is illustrated in FIG. 2. The circuit 200 essentially operates as a feedback control loop to maintain the two input nodes of amplifier 217 at approximately the same potential in the steady state. In so doing, the circuit 200 amplifies the difference $\Delta V_{be}$ between the voltages across diodes $D_1$ and $D_2$ which are operating at different values of current density due to their different cross-sectional areas. The difference $\Delta V_{be}$ will have a positive temperature coefficient, i.e., a rising slope as a function of temperature, as shown by the required compensation voltage line in FIG. 1, and will typically be several times smaller than the negative temperature coefficient $V_{be}$. If the currents in the two unequal area diodes $D_1$ and $D_2$ are assumed to be the same in the steady state, and $R_2$ is set equal to $R_3$ for easy manipulation of the numbers, then the following equation may be derived by one skilled in the art:

$$V_{out}=\Delta V_{be}(R_2/R_1)+V_{be}$$

where $\Delta V_{be}=V_{D1}-V_{D2}$, $V_{be}=V_{D1}$. The ratio $R_1/R_2$ is then selected as a gain factor to give $V_{out}$ approximately equal to the zero Kelvin bandgap energy in electron volts of silicon, i.e., 1.205 volts. Thus, the bandgap principle introduced above is implemented with $V_{out}$ being the temperature compensated reference voltage.

The bandgap reference 200 is an effective technique for obtaining a reference voltage of approximately 1.2 volts given a supply voltage of a few volts. The last 20 years, however, has seen a steady reduction in the supply voltage used for commercial electronic systems. Older systems typically operated based on a 5 volt supply, while many modem electronic systems that include very dense integrated circuits (ICs) now operate at approximately 3 volts. Electronic systems of the future will need to operate with even lower supply voltages of 1.5 volts or less. The lower headroom is required to maintain the reliability of future ICs by reducing their power densities. Lower supply voltages also reduce total power requirements thereby permitting extended operation time for portable electronics that use batteries. Furthermore, circuits that can operate with low supply voltages can be made compatible with the lower output of solar cells, thereby contributing to a cleaner environment.

The topology of bandgap reference 200 in FIG. 2, however, may require relatively high headroom in a supply voltage of a few volts or greater with respect to ground. Moreover, the reference output $V_{out}$ lies typically between 1.2 and 1.3 volts, clearly unsuitable for systems having a 1.5 volts supply. Thus, to meet the challenge of such systems, there is a need to develop a low cost voltage reference circuit that can operate with supply voltages of 1.5 volts or less and that provides a reference output well below 1 volt.

SUMMARY

The invention is directed to a method for generating a reference signal. A first signal having a first value and a negative temperature coefficient is generated. A second signal having a second value and a positive temperature coefficient is generated. The first and second signals are sampled and stored on first and second capacitive elements, respectively. A low impedance path is created between the first and second capacitive elements to yield the reference signal across one of the capacitive elements.

BRIEF DESCRIPTION OF THE DRAWINGS

The invention is illustrated by way of example and not by way of limitation in the figures of the accompanying drawings in which like references indicate similar elements. It should be noted that references to "an" embodiment in this disclosure are not necessarily to the same embodiment, and they mean at least one.

DETAILED DESCRIPTION

The embodiments of the invention described in detail below are directed at a semiconductor circuit that generates a precise and stable reference voltage smaller than the semiconductor bandgap voltage and requiring low head room. The circuit achieves such a result by taking the average of a generated first signal having a negative temperature coefficient and a generated second signal having a positive temperature coefficient. The first and second signals are potentials that substantially track each other in opposite directions, their average therefore being temperature-compensated. In a preferred embodiment, the two signals are linearly separable components related to $\Delta V_{be}$ and $V_{be}$ obtained using a technique similar to those used in conventional bandgap reference circuits.

The following detailed description of the various embodiments of the invention may often refer to specific numbers when describing the operation of various circuit elements. This is done only for purposes of explanation and not to define the actual scope of the invention. One skilled in the art will recognize that other numerical combinations may be readily available to accomplish substantially the same result, or to meet different performance requirements such as total power consumption, transient circuit response, and manufacturability.

Figure 1:
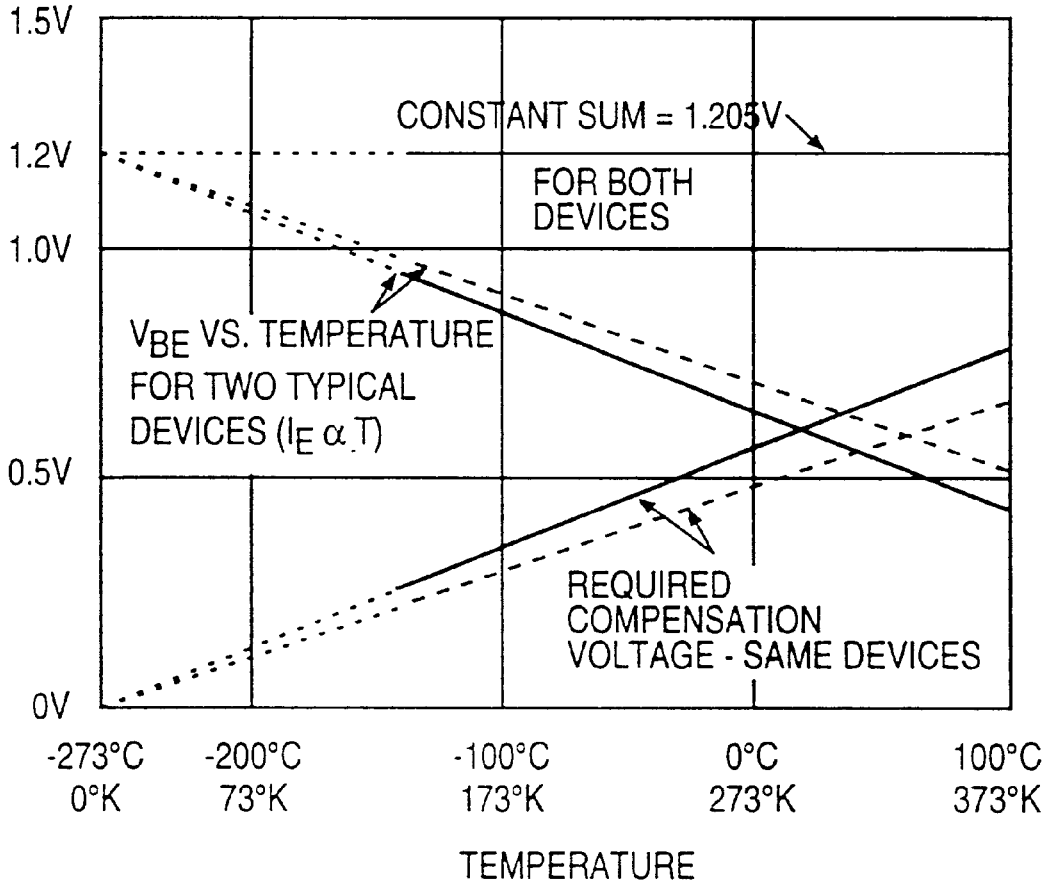
FIG. 1 (PRIOR ART)
FIG. 1 shows the known variation of $V_{be}$ with temperature for two unequal area devices, and the required compensation to achieve the sum constant bandgap voltage.
Figure 2:
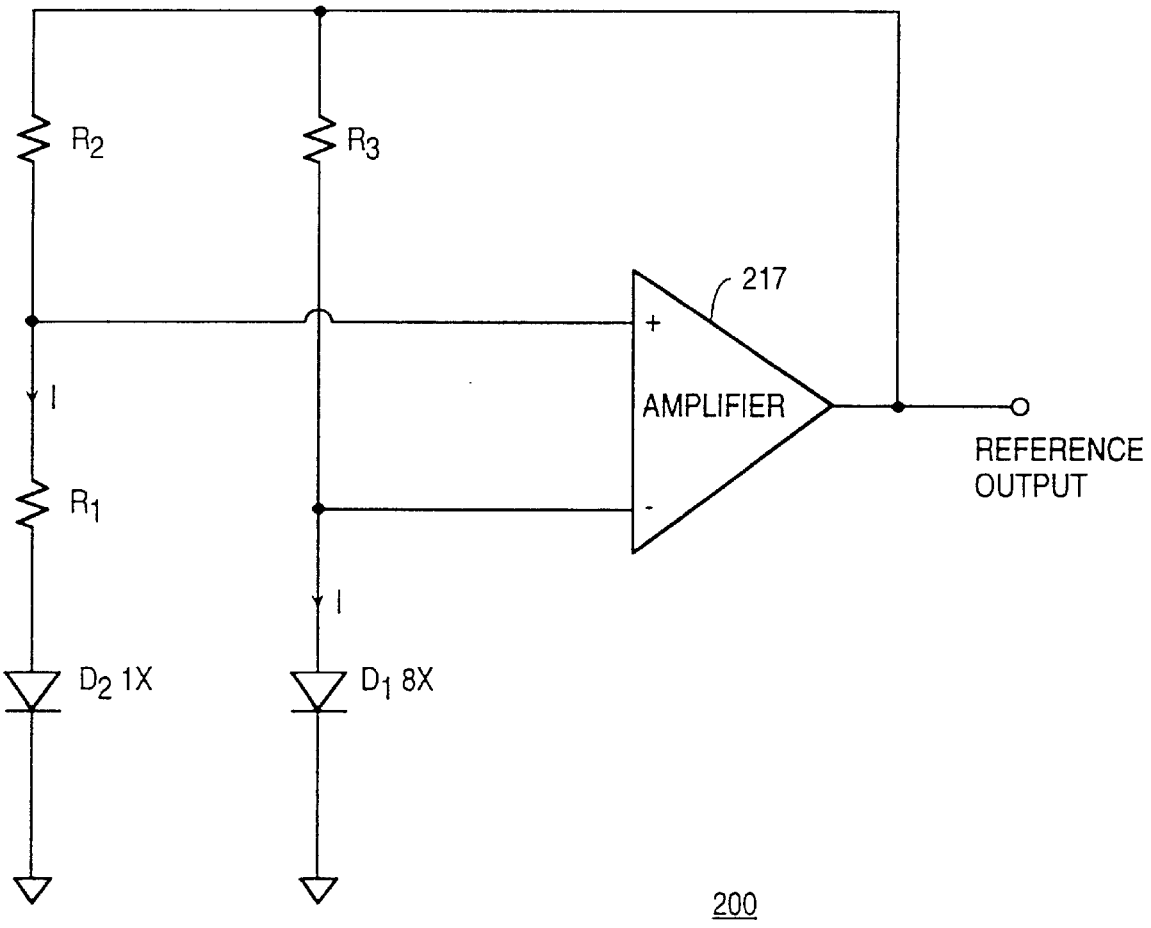
FIG. 2 (PRIOR ART)
FIG. 2 illustrates a prior art bandgap reference circuit.
Figure 3:
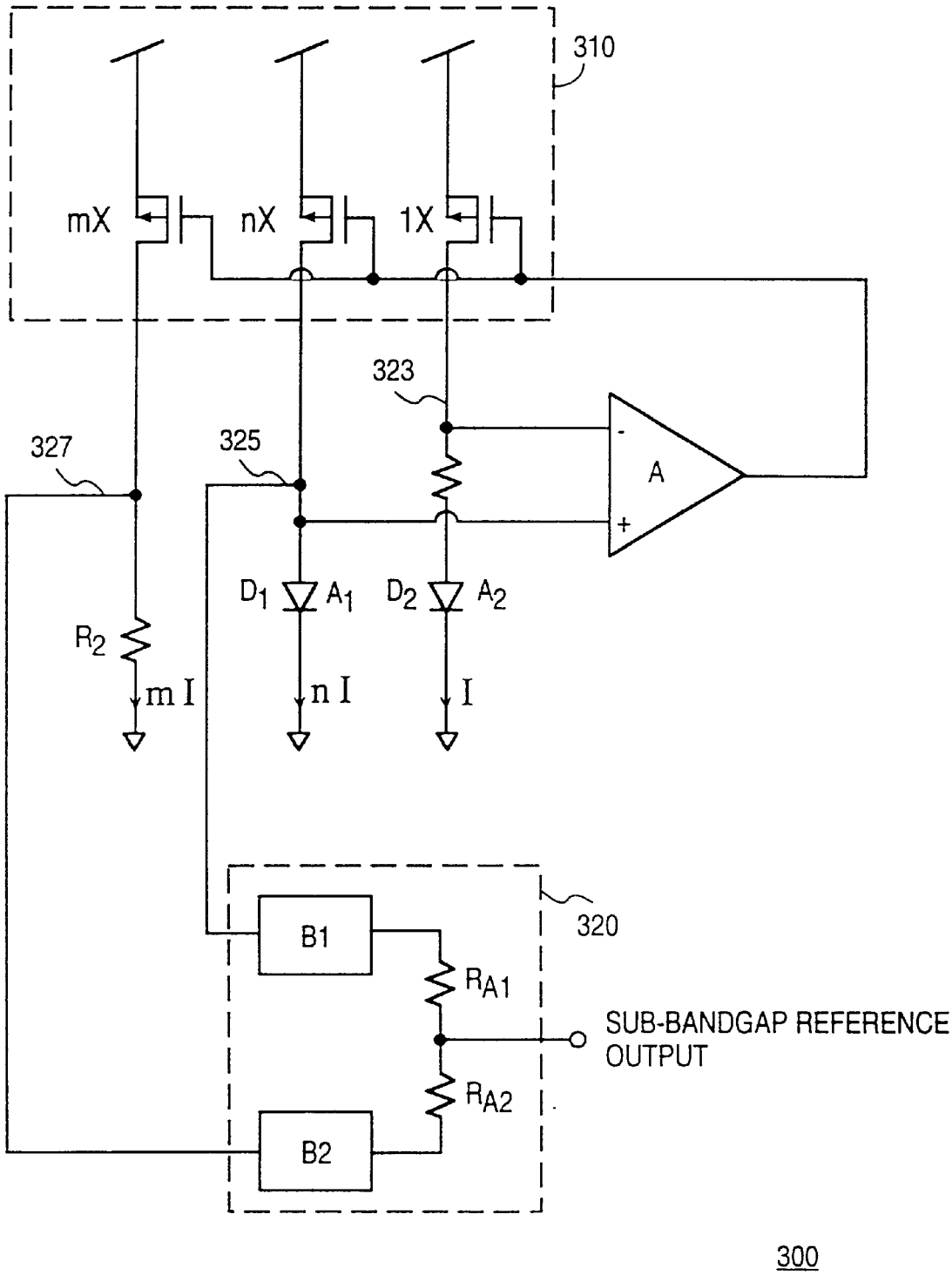
FIG. 3 shows a low supply voltage sub-bandgap reference circuit according to an embodiment of the invention.

FIG. 3 illustrates a sub-bandgap reference circuit 300 according to a preferred embodiment of the invention. The circuit 300 features a controlled current source 310 having an area-ratioed current mirror with three outputs feeding diode-like element $D_2$, diode-like element $D_1$, and resistor $R_2$, respectively. The voltage across $D_1$ is represented as $V_{D1}$ or $V_{be}$, the voltage across $D_2$ is $V_{D2}$, and the difference $V_{D1}-V_{D2}=\Delta V_{be}$ or $\Delta V_{be}$. Diode-like element $D_2$ is coupled to the current source 310 in series with a resistor $R_1$. An averaging circuit 320 is coupled to $R_2$ and $D_1$ and provides an output voltage that is approximately the average of the voltages across $R_2$ and $D_1$.

The extensive analysis and description below will show that the voltages across $R_2$ and $D_1$ are related to the two opposite but equal-tracking (as a function of temperature) components $\Delta V_{be}$ and $V_{be}$ conventionally seen in a bandgap reference circuit. Thus, the controlled source 310, amplifier A, and the network $R_1$–$R_2$–$D_1$–$D_2$ may be identified as the $\Delta V_{be}$-$V_{be}$ circuitry of this embodiment which generates signals related to $V_{be}$ and $\Delta V_{be}$. The circuit 300 should be designed so that the temperature coefficient of the two signals precisely cancel each other when the two are equal. To accomplish this with minimum sensitivity to circuit parameters such as amplifier offsets, the circuit 300 features the use of a current mirror in controlled source 310 with non-equal current mirroring to increase the voltage term or signal related to $\Delta V_{be}$. It is desirable to make this term as large as possible to reduce the effects of errors (difference between design and actual values of circuit elements) and offsets in the amplifier A. Finally, the average of the $\Delta V_{be}$ and $V_{be}$ related signals from $R_2$ and $D_1$ yields a temperature compensated voltage of approximately one-half the bandgap voltage of the semiconductor used for the diodes.

A key advantageous aspect of circuit 300 as well as other embodiments of the invention lies in the low headroom (low supply voltage) required by the circuit for operation. The low headroom is achieved by having at most one FET threshold voltage drop (VT) above nodes 323, 325 and 327. This allows the circuit 300 to operate with supply voltages of 1.5 volts or less.

Another advantageous aspect of the sub-bandgap circuit 300 in FIG. 3 is that the undesirable effects of different channel modulation on the different drain currents of the FETs in the current source 310 is reduced, because the operating drain-source voltages of the FETs are to be substantially equal by design. As explained more fully below, the voltages at nodes 327, 325 and 323 will be approximately equal, as required by the condition $K\Delta V=V_{D1}$ needed to obtain a sub-bandgap temperature compensated output. By reducing such channel modulation in the FETs, the individual currents mI, nI, and I in the manufactured circuit will more precisely track the designed area ratio values of 1:n:m.

Circuit Operation of the First Embodiment

The circuit 300 includes an amplifier A (loop amplifier) whose output drives the current source 310 in response to inverting and non-inverting inputs received from $D_1$ and the line containing $D_2$. The amplifier A may be an operational amplifier that provides high open loop gain at low supply voltages of less than 1.5 V. An embodiment of the amplifier A is described below in connection with FIG. 6.

Turning to FIG. 3, in the steady state, the control loop that includes amplifier A drives the current source 310 such that the inverting and non-inverting inputs of amplifier A are approximately at the same potential, and the current I becomes constant. In that case, the respective currents through $D_2$, $D_1$ and $R_2$ are assigned to be I, nI, mI, (where n and m are positive numbers greater than one). Using the definitions for $V_{D1}$, $V_{D2}$, and $\Delta V$ above, the following mathematical relation may be written based on voltage loop equations from circuit 300:

$$IR_1+V_{D2}=V_{D1}$$

$$I=\Delta V/R_1 \text{ and}$$

$$V_3=mIR_2=m\Delta V(R_2/R^1) \tag{1}$$

where $V_3$ is the voltage at node 327. Thus, the inputs to the averaging circuit are $m\Delta V(R_2/R_1)$ and $V_{D1}$, the average of which yields a sub-bandgap temperature compensated voltage.

In order for a bandgap reference circuit to properly develop a temperature-compensated voltage, the difference between the design values and the actual values of the output voltage should be minimized. Even a 10 millivolt error may adversely affect the robustness of the output voltage in view of temperature as well as supply voltage variations. To achieve this accuracy, a more formal and mathematical explanation of the behavior of the sub-bandgap circuit now follows. The treatment may be used by one skilled in the art to further optimize the performance of the sub-bandgap circuit.

If the diode-like elements $D_2$ and $D_1$ have current area ratio $A_2$:$A_1$ ($A_2>A_1$), then the following expression may be written for $V_3$:

$$V_3=\frac{mkT}{q}\ln\left[\frac{nI}{A_1}\cdot\frac{A_2}{I}\right] \tag{2}$$

where T is temperature in Kelvin, q is electronic charge, and k is the Boltzmann constant.

$V_{D1}$ (hereinafter abbreviated as $V_D$) is a non-linear function of temperature and is given by the well-known equations $$V_D = \frac{kT}{q}\ln\left[\frac{I}{I_s}\right]$$

$$I_s = cT^{\eta}e^{-V_g q/kT}$$

where $V_g$ is approximately =1.205 volts (bandgap voltage of silicon)

$\eta$ is approximately=1.5 and c is a proportionality constant related to the area of the diode.

We may assume that in the steady state, the currents I, nI, and mI will be relatively invariant with temperature as compared to the variation of a diode voltage drop $V_{D1}$, such that $\Delta V$ and $V_3$ as given above in (1) and (2) are substantially linearly proportional to temperature.

Since $V_{D1}$ decreases nonlinearly in value with temperature, while AV exhibits a substantially linear variation, there is only one value of $V_{D1}$ and T for which $$K\frac{d\Delta V}{dT} = \frac{dV_{D1}}{dT} \tag{3}$$

where K is a constant gain factor (independent of temperature) to be selected such that (3) holds. The gain factor K is needed because the value of $\Delta V$ is typically several times smaller than $V_{D1}$ for a given temperature and current. This linear versus non-linear aspect of the invention is an important consideration in realizing the optimum value of the sub-bandgap output.

Theoretically speaking, the condition (3) is necessary but may not be sufficient to generate a sub-bandgap voltage that is temperature invariant along the entire temperature range 0° C. to 100° C., because although the temperature coefficient of the $\Delta V$ term is fixed with respect to temperature, the temperature coefficient of $V_{D1}$ is not.

Nevertheless, an approximate operation of circuit 300 to obtain the optimal resistor values and transistor dimensions may be explained by realizing that the circuit 300 contains a linearly separable voltage loop containing $R_2$. In other words, it can be shown that connecting $R_2$ to node 325 instead of common return (ground) allows a temperature-compensated output of approximately 1.2 volts (the bandgap voltage) to be generated at node 327. Therefore, circuit 300 for the sub-bandgap may be analyzed by evaluating the behavior of a modified circuit having resistor $R_2$ connected to node 325. For that scenario, an expression can be obtained for the voltage at node 327 with respect to ground as a function of temperature as follows.

Since the voltage $V_3$ at node 327 is equal to a diode drop $V_{D1}$ across $D_1$ plus a voltage drop across resistor $R_2$, the following equation may be written:

$$V_3 = mIR_2 + V_{D1} \tag{4}$$

Differentiating (4) with respect to temperature and setting it equal to zero, and solving for the temperature at which $dV_3/dT$ is equal to zero gives the optimal voltage $V_{D1}$ at which the variation with temperature is the lowest over the entire temperature range. This is because the variation of $V_3$ with temperature is slightly non-linear such that the temperature T and voltage $V_{D1}$ for which the slope of $V_3$ is equal to zero may be used to compute the optimal $V_3$ reference voltage. To obtain the desired expression for $$\frac{dV_{out}}{dT},$$

an expression may be written for current I based on the above equations as $$I = CT^{\eta}e^{\frac{q}{kT}(V_{D1}-V_g)} \tag{5}$$

Differentiating I in (5) with respect to temperature T gives $$dI_c = C_{\eta}T^{\eta-1}e^{\frac{q}{kT}(V_{D1}-V_g)}dT - CT^{\eta}e^{\frac{q}{kT}(V_{D1}-V_g)}\frac{q}{kT}(V_{D1}-V_g)\frac{dT}{T} \tag{6}$$

The equation (6) can be simplified and rewritten by substituting equation (5)

$$dI_c = \frac{\eta}{T}I_c dT - \frac{q}{kT}I_c\frac{V_{D1}-V_g}{T}dT + \frac{q}{kT}I_c dV_{D1} \tag{7}$$

To simplify further analysis, we may assume that because the variation of $I_c$ with temperature is relatively flat, $$\frac{I_c}{T} = \frac{dI_c}{dT} \tag{8}$$

By substituting (8) into (7), we can rewrite (7) as $$\frac{dV_{D1}}{dT} = \frac{k}{q}(1-\eta) + \frac{V_{D1}-V_g}{T} \tag{9}$$

Now, differentiating (4) and substituting (8) gives $$\frac{dV_{out}}{dT} = R\frac{I_c}{T} + \frac{k}{q}(1-\eta) + \frac{V_{D1}-V_g}{T} \tag{11}$$

Using $$V_{out}\Big|_{T=T_0} = V_{D1}\Big|_{T=T_0} + I\Big|_{T=T_0}R_2 = V_g - \frac{kT_0}{q}(1-\eta)R_2 \tag{12}$$

which shows the bandgap condition $V_g = K\Delta V + V_{D1}$ holds at absolute zero and at room temperature. Next, using $$V_{D1}\Big|_{T_0} = V_g - \frac{kT_0}{q}(1-\eta) - I\Big|_{T_0}R_2 \tag{13}$$

and substituting (13) into (11) gives $$\frac{dV_3}{dT} = \frac{k}{q}\left(1-\eta\left(1-\frac{T}{T_0}\right)\right) \tag{14}$$

integrating (14) with respect to temperature gives $$V_3 = V_g - \frac{k}{q}T(1-\eta)\left(1-\ln\left(\frac{T}{T_0}\right)\right) \quad (15)$$

where $T_0$=296 Kelvin. Thus, equation (15) gives an expression of the temperature dependency of a full bandgap (1.2 v) reference output. Using conventionally available numerical techniques, (15) was evaluated for a temperature range from 200–400 Kelvin. The results indicate that $V_3$ varies between 1.217 volts to 1.218 volts, using a value for $\eta$ of 1.5, $V_g$=1.205, and $kT_0/q$=26 millivolts.

Given that a temperature-compensated full bandgap output $V_3$ has been determined for the modified circuit 300 having $R_2$ connected to node 325, the circuit designer can select particular numbers for the components of the original circuit 300 to yield the temperature-compensated sub-bandgap output by taking advantage of the linearly separable characteristics of the circuit 300.

To repeat, the voltage across $R_2$ is proportional to $\Delta V$ (and will thus exhibit a positive temperature coefficient), while the voltage $V_{D1}$ will exhibit a substantially equal tracking but opposite negative temperature coefficient. However, because the temperature tracking of the two signals are not exactly equal (due to one being non-linear while the other is linear, as discussed above), there is only one temperature and diode voltage $V_{D1}$ at which $K\Delta V$ and $V_{D1}$ have exactly the same but opposite temperature coefficients. That point is the temperature and voltage for which $K\Delta V=V_{D1}=V_g/2$ where $V_g$ is the bandgap voltage of silicon. Thus, $K\Delta V$ and $V_{D1}$ will be equal to $V_3/2$ when resistor $R_2$ was connected to node 325, provided of course that the operating steady state conditions of the modified circuit 300 are unchanged for the sub-bandgap circuit 300, i.e., the currents through $R_2$, $D_1$, and $D_2$ remain substantially unchanged.

In a computer simulation performed on the circuit 300, a precise and stable sub-bandgap reference output of approximately 0.605 volts was indeed generated using a supply voltage of only 1 volt. The reference output exhibited a temperature coefficient of less than 80 parts per million (ppm) over a temperature range of approximately 0 to 150 degrees Celsius and less than 50 ppm over 0 to 50° C. The total power consumption of the sub-bandgap reference (including associated power-on-reset and current reference circuitry to be described below) was approximately 100 microWatts.

Description of second embodiment

Figure 4:
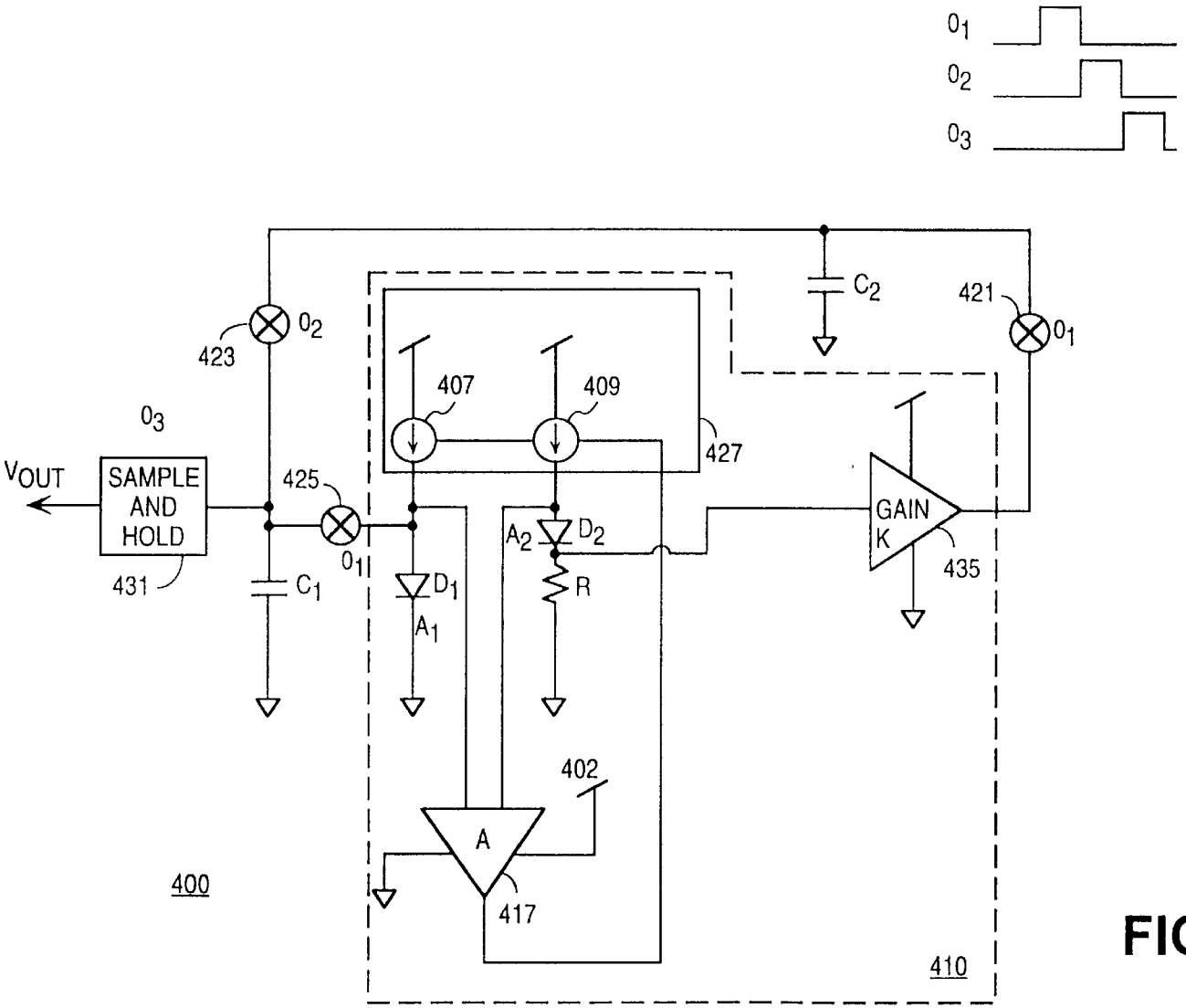
FIG. 4 depicts another embodiment of the sub-bandgap reference circuit of the invention.
Figure 5:
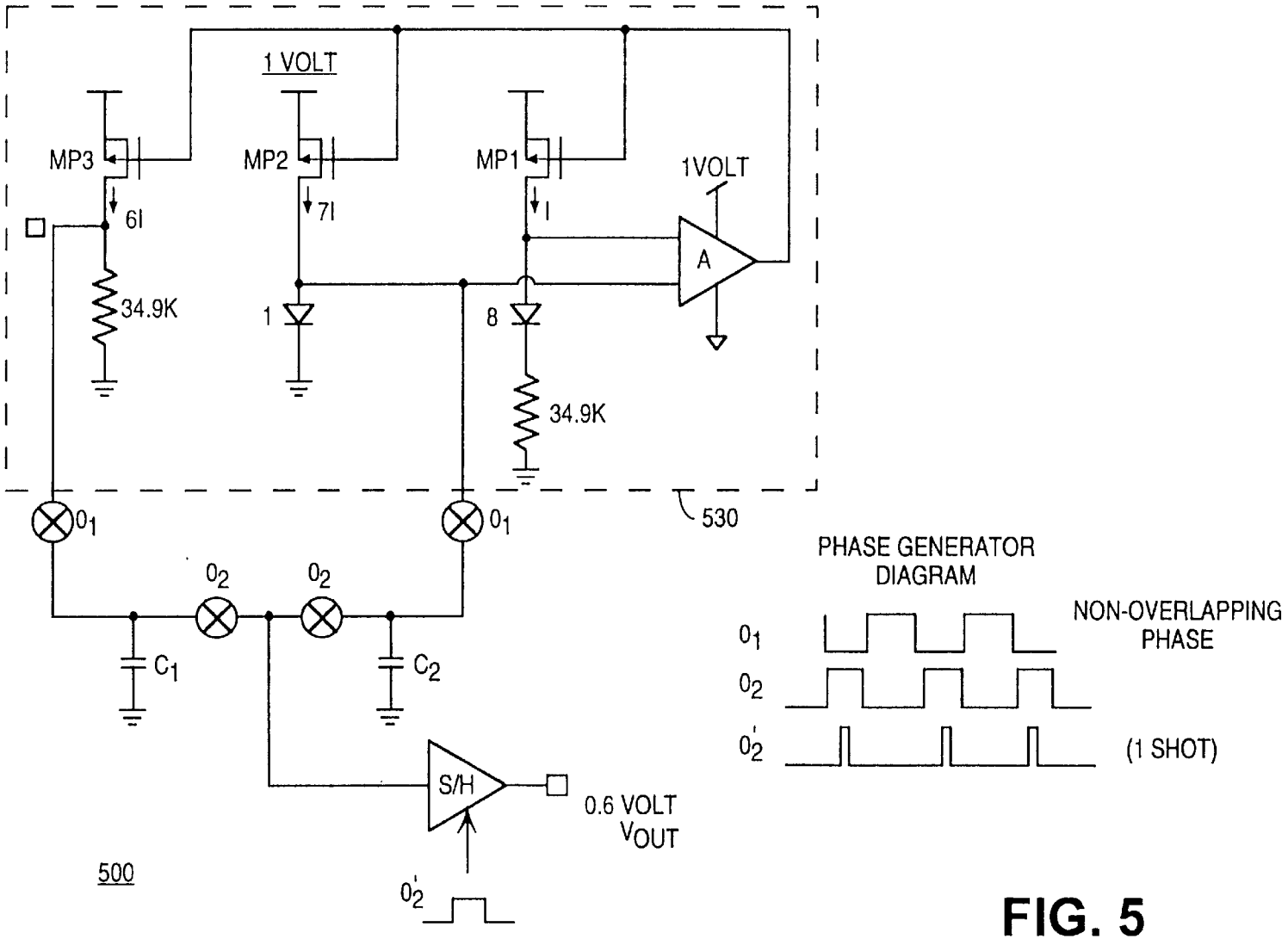
FIG. 5 illustrates yet another embodiment of the invention's sub-bandgap reference circuit.

FIGS. 4 and 5 illustrate other embodiments of the sub-bandgap reference of the invention as circuits 400 and 500. In circuit 400, bandgap circuitry represented by block 410 is configured to provide the diode voltage $V_{D1}$ having a negative temperature coefficient and a voltage $\Delta V$ taken across R and having a positive temperature coefficient. The amplifier 417 has high open loop gain and drives controlled current source 427 such that in the steady state the voltage at the two input nodes of amplifier 417 are approximately equal. Gain block 435 is used to scale up $\Delta V$ such that at room temperature, $V_{D1}=K\Delta V$ holds as a necessary condition for the existence of a sub-bandgap temperature-compensated output at $V_{out}$.

The gain factor K and the necessary $\Delta V$ required to meet the bandgap condition may be obtained through several techniques. One such technique uses a switched capacitor implementation for the gain block 435. Gain block 435 should preferably provide substantially parasitic-free gain with low output impedance as compared to switch 421 and capacitive element $C_2$, as well as a high input impedance as compared to the value of R.

The averaging circuitry in FIG. 4 includes the switched capacitor network of $C_1$ and $C_2$ and the switches 421 and 425. By placing the necessary charge for each signal $V_{D1}$ and AV in a capacitive element, and then shorting he capacitive elements together by a low impedance path, and average of the two signals can be obtained at $V_{out}$.

An example of such a technique uses two capacitive elements $C_1$ and $C_2$ as shown in FIG. 4. In one embodiment, each of $C_1$ and $C_2$ may exhibit a capacitance on the order of a few tenths of a picoFarad, and are selected so as to reduce matching errors between the two elements (differences between design values and actual manufactured values), and to avoid sensitivity to capacitive and inductive parasitic effects present in the rest of the circuit. In the embodiment of FIG. 4, $V_{D1}$ and $\Delta V$ are sampled almost simultaneously and corresponding charges $Q_1=C_1V_{D1}$ and $Q_2=C_2K\Delta V$ are placed in their respective capacitive elements via switches 425 and 421 in response to a control signal having phase $\phi_1$. Next, a path having the lowest possible impedance between $C_1$ and $C_2$ is created by switch 423 in response to a control signal having phase $\phi_2$. By effectively shorting $C_1$ and $C_2$, a new capacitive element is created with $$Q=(C_1+C_2)V$$

where V is the voltage across the now shorted capacitive elements $C_1$ and $C_2$. Substituting $Q_1+Q_2$ for Q and solving for V gives $$V=(Q_1+Q_2)/(C_1+C_2)$$
$$=(C_1V_1+C_2K\Delta V)/(C_1+C_2)$$
$$=(V_{D1}+K_CK\Delta V)/(1+Kc)$$

where $K_c$ is the ratio $C_2/C_1$. If $C_1$ is set equal to $C_2$, then the above equation gives $$V=(V_{D1}+K\Delta V)/2$$

i.e., the voltage across the shorted capacitive elements $C_1$ and $C_2$ is the average of $V_{D2}$ and $K\Delta V$, the desired sub-bandgap output. The voltage V is then sampled by sample-and-hold 431 in response to a control signal having phase $\phi_3$ as shown in FIG. 4.

The three control signals are normally periodic and have non-overlapping phases $\phi_1$, $\phi_2$ and $\phi_3$. The details of the control signals, namely the pulse amplitude and width, and the separation between successive signals as well as their frequency, are functions of the capacitance values for $C_1$ and $C_2$, the voltages across $D_1$ and $D_2$, the switching speed and impedance of the switches 425, 421, and 423, as well as the relevant characteristics of sample-and-hold 431, as will be apparent to one skilled in the art.

The averaging circuitry of the embodiment in FIG. 4 includes all circuitry outside the bandgap block 410, including switches 421, 425, and 423, as well as capacitive elements $C_1$ and $C_2$, and finally sample-and-hold 431. The averaging circuitry may also include the use of conventional techniques for generating the control signals $\phi_1$, $\phi_2$, and $\phi_3$ having non-overlapping phase for controlling the switched capacitor network of $C_1$ and $C_2$ and the sample-and-hold. Other designs to accomplish essentially the same results as the averaging circuit in FIG. 4 using switched capacitors are possible, as shown in FIG. 5. In all cases, however, the averaging circuit must yield the sub-bandgap reference output signal $V_{out}$ as an average of samples taken from the $K\Delta V$ and $V_{D1}$ signals.

Utilizing a switched capacitor design provides the advantages of lower manufacturing costs, easy implementation on a CMOS process, and lower power consumption. However, one disadvantage of using a switched capacitor design for gain block 435 is the introduction of switching noise. The switched capacitor network provides several advantages, such as very low power, excellent ratioing (leading to low matching errors in capacitance values), and digital control, in an otherwise relatively simple package comprising only two capacitors and a sample-and-hold amplifier.

However, a key disadvantage of the switched capacitor network is the difficulty of operation at supply voltages less than 1.5 volts, where switches 421, 423, and 425 may have particular difficulty in switching properly with such low headroom. Furthermore, current glitching due to the fast switching of FETs used in the switches may also be a problem, not only with respect to a source-drain current component but also with respect to a well component in a p-channel (n-well process) FET. To solve the above problems with the switched capacitor network, complex electronic circuitry may be needed that as a result complicates the design of a sub-bandgap reference circuit. Finally, the addition of the switched capacitor network may introduce undesirable parasitics to the sub-bandgap reference circuit.

Nevertheless, another embodiment of the sub-bandgap circuit using a slightly modified switched capacitor network for the averaging circuit is shown in FIG. 5. To obtain $V_{D1}$ and $K\Delta V$, the circuit 500 features the $\Delta V_{be}$-$V_{be}$ circuitry 530 which also appears in circuit 300 of FIG. 3. The description and operation of the circuit 500 will be self-explanatory to one skilled in the art in light of the above discussion concerning FIGS. 3 and 4.

Circuit Components for Implementing the Embodiments of the Invention

The invention's sub-bandgap reference circuit employs an amplifier A for the control loop in all of the embodiments of the invention in FIGS. 3–5. The amplifier A should provide high gain with low offset over as wide of a common mode voltage range as possible. One possible implementation for the amplifier A is a folded cascode design. A folded cascode design is well-known for its capabilities in reducing noise at its output due to ripple on the power supply. The folded cascode design also provides increased common mode input range. However, the folded cascode design may not provide enough gain and stability at supply voltages close to 1 volt where the supply voltage can be as low as the threshold especially if the input common mode voltage is at ½ the supply.

Figure 6:
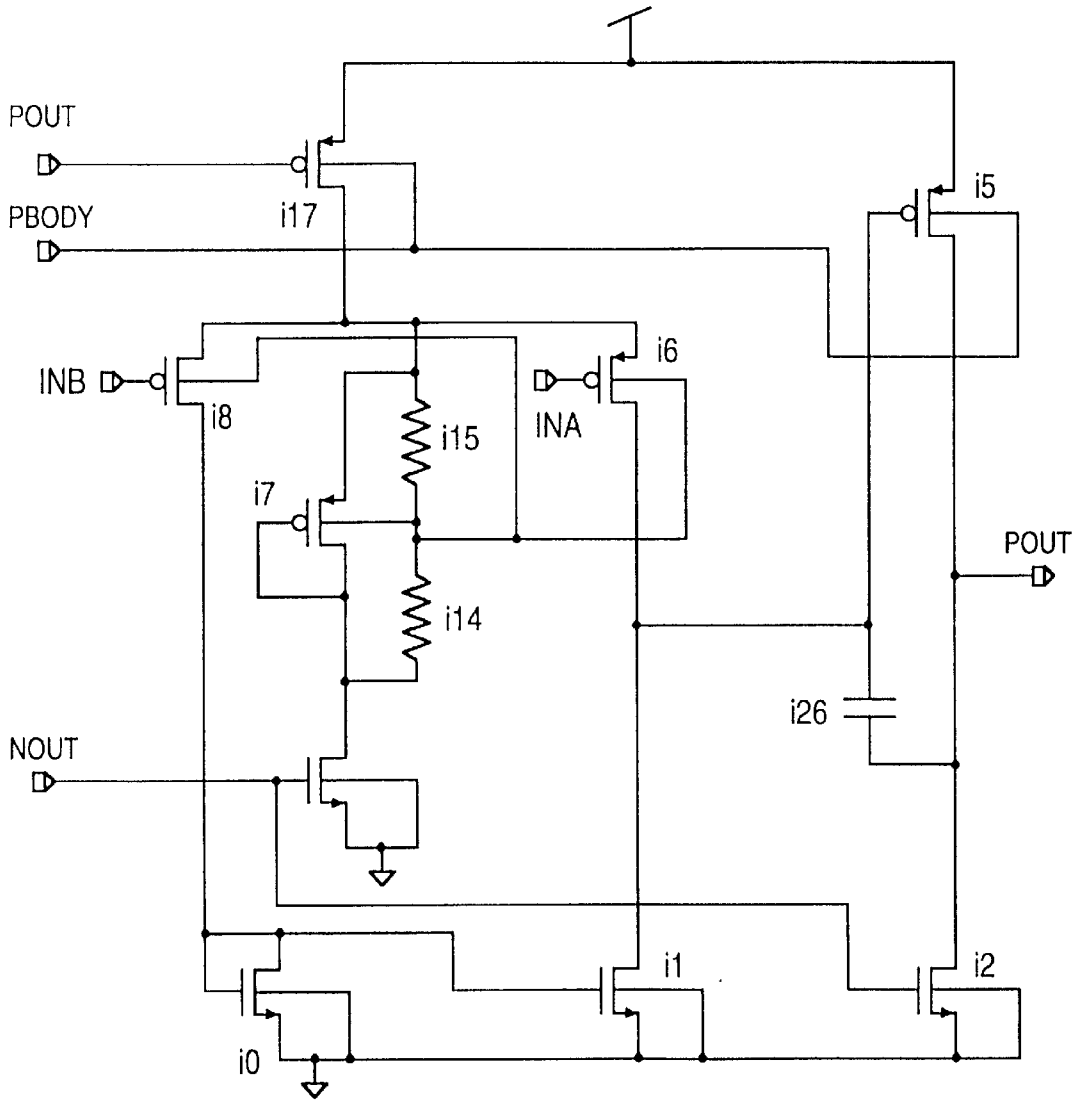
FIG. 6 illustrates an operational amplifier for use in an embodiment of the invention's sub-bandgap reference.

As an alternative to the folded cascode design, FIG. 6 is a schematic of an amplifier A that was satisfactorily simulated for operation at approximately 1 volt supply. The amplifier features a differential input stage wherein the input transistors I6 and I8 are p-channel FETs in a n-well fabrication process, and wherein the well of each FET receives a well-bias signal of approximately $V_T/2$ from p-channel FET I7. Carefully biasing the bulk (well) to substrate junction of a MOSFET near the turn on potential is used to reduce its effective threshold voltage. This is combined with well stacking or connecting the sources of the MOSFETs to the bulks to eliminate backgating or body effects, where possible, and to also reduce the threshold on stacked devices. Such a well biasing technique is also used in subcircuits of other embodiments of the invention described below to lower the effective threshold voltage of FETs.

For example, the effective threshold of a p-channel FET in a n-well process, for example, at the gate inputs of I6 and I8 of amplifier A in FIG. 6, may be reduced by slightly forward biasing the bulk (well) with respect to the source by approximately 3/10 volt. This well biasing scheme reduces the headroom required for proper operation of the differential input stage of amplifier A.

The amplifier also features an output stage providing a large voltage gain through p-channel FET I5 that also receives a well-bias signal. This provides high open loop gain, which helps reduce the error in the value of the sub-bandgap output voltage. The well-bias signal PBODY is obtained from a different circuit, the low voltage current source (LVCS) or low-bias current generator cell of FIG. 7 described below. The well biasing scheme reduces the threshold voltage of a p-channel FET realized in a n-well. The n-well typically has an available terminal that can be set at any arbitrary bias. In FIG. 6, the bias comes from a resistor divider I14 and I15 connected to the source and drain of the diode-connected p-channel FET I7. The sum resistor value is selected such that the current through I7 is several times greater than the current through I14 and I15. FIG. 6, for example, shows the resistors as 250 kOhms each with I7 having W/L=10/2 (in micrometers).

There may be potential problems with a well-bias design for the amplifier A in FIG. 6 if the design does not track the device threshold voltages of different production lots. By using a fixed divider across the reference FET I7, a threshold voltage tracking effect is achieved that makes the well-bias design of the amplifier A substantially independent of the fabrication process. Also, substrate contacting will help absorb the slight forward current (up to a few nanoAmps) in the well-to-substrate junction.

Techniques to further improve operation of the amplifier A at low supply voltages include the use of shorter channel and wider gate FETs to further reduce the threshold voltage of the FETs. To minimize the overall input offset voltage of the amplifier in FIG. 6, the dimensions of the various transistors in both stages of the amplifier can be adjusted so that an input offset presented by the output stage (including FET I5) is opposite in direction to the offset of the differential stage. Also, the relatively high gain of the output stage (including FET I5) helps reduce overall input offset by reducing the offset contribution of the differential stage to the overall offset.

Figure 7:
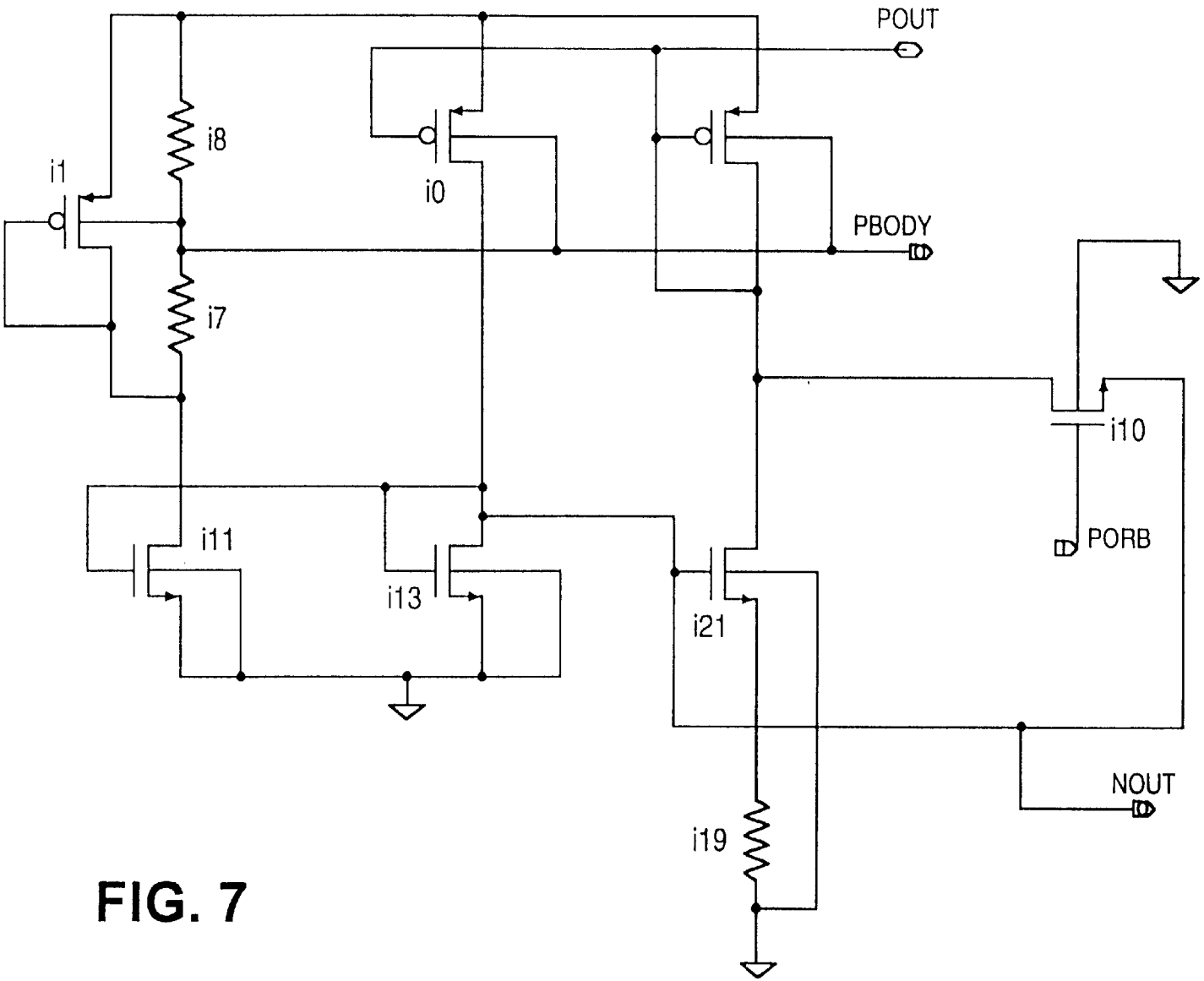
FIG. 7 is a schematic of a low-bias current generator cell for use in a current source block of another embodiment of the invention's sub-bandgap reference.
Figure 9:
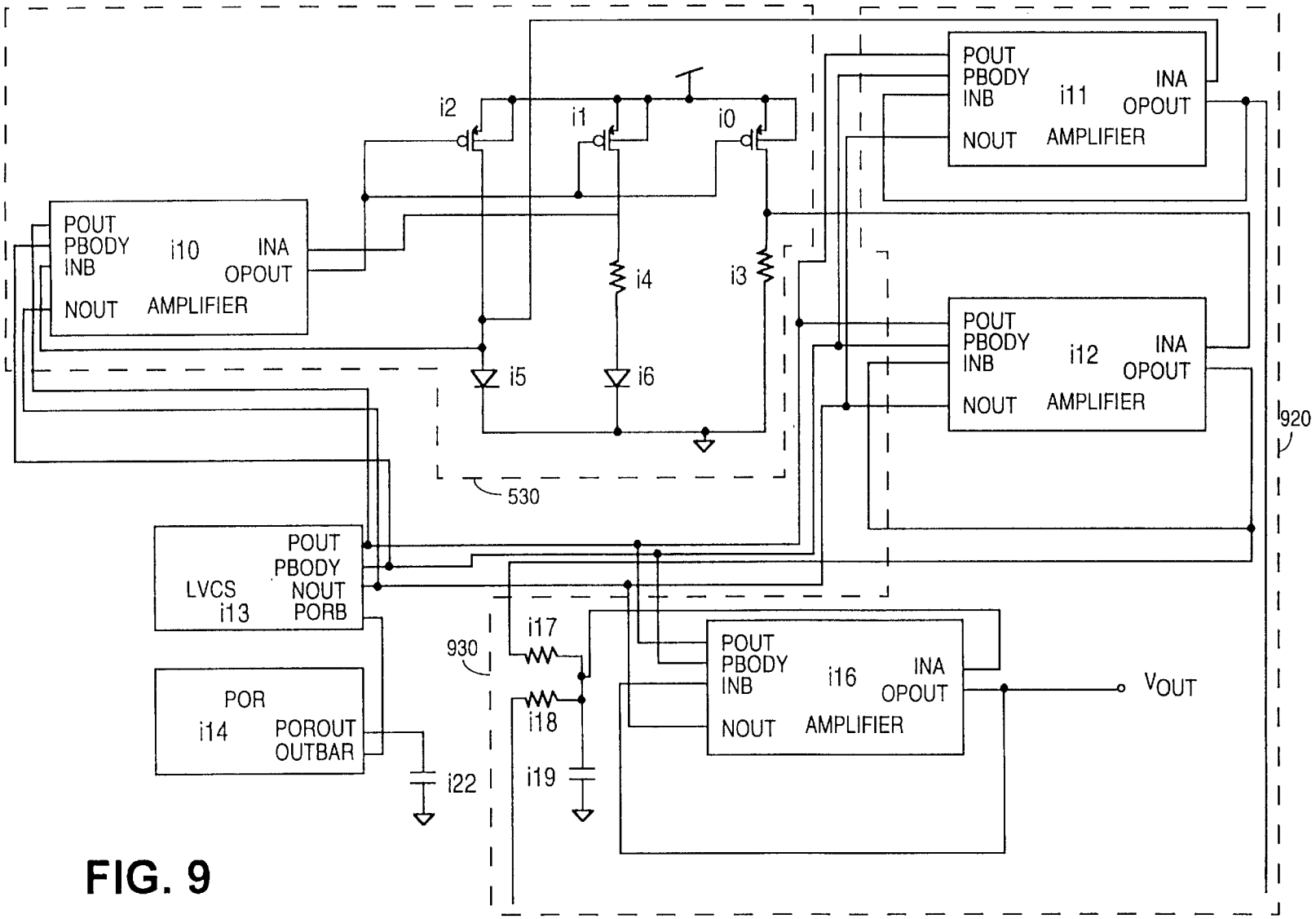
FIG. 9 is a schematic of another embodiment of the invention's sub-bandgap reference including the power-on-reset and current source blocks.

Another part of the embodiment of the invention in FIG. 9 is the current source block I13 containing the LVCS of FIG. 7. The LVCS supplies biasing to various parts of the sub-bandgap reference circuit. The LVCS uses a MOSFET sub-threshold biasing scheme that generates a delta VT across a resistor I19 in FIG. 7. This technique is effective in very low power or low voltage applications. The LVCS includes a conventional current loop bias generator using a Vittoz $\Delta V_T$ sub-threshold scheme. When operating in the sub-threshold region, an FET exhibits logarithmic drain current characteristics rather than the square law behavior in the normal operating region. The sub-threshold operating mode is based on diffused carriers (minority) instead of drift current (majority) which is the normal operating mode of an inverted surface FET. There are many desirable characteristics of an FET operated in this region, including maximum available gain and ability to use the FET as a reference.

The negative aspect of operating in the sub-threshold region is susceptibility to offset and noise as well as the difficulty of modeling FETs in this region. However, when the sub-threshold-biased MOSFET is used as a current source, most of these effects may be tolerated. In this region, the voltage drop across the source resistor I19 is a $\Delta V_{be}$ ($\Delta V_T$) which reduces to a constant $$\left(\frac{kT}{q}\ln\frac{I_1}{A_1}-\frac{kT}{q}\ln\frac{I_2}{A_2}\right)=\frac{kT}{q}\ln\left(\frac{I_1}{I_2}\right)$$

for areas $A_1=A_2$.

Well biasing is also used in the LVCS of FIG. 7 to reduce the supply operating voltage, obtained by resistors I7 and I8, and FET I1 having W/L=100/10.

Figure 8:
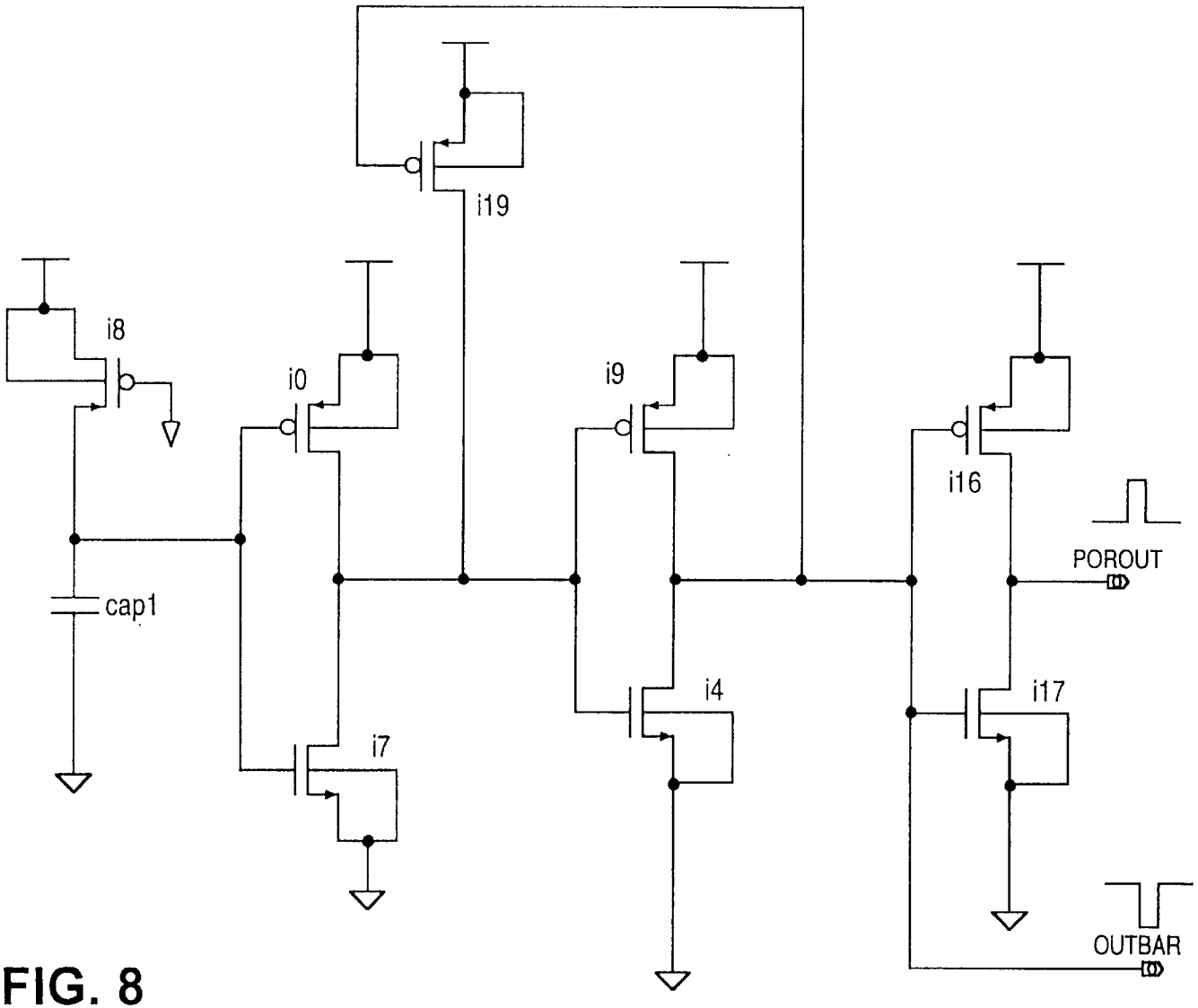
FIG. 8 is part of a power-on-reset block for kick starting the $\Delta V_{be}$-$V_{be}$ circuit according to another embodiment of the invention.

Another component of the circuit in FIG. 9 is the Power On Reset (POR) circuit which is shown in FIG. 8. The POR is based on an RC circuit and threshold voltage of a p-channel. The POR circuit operates from the same low supply voltage as the rest of the sub-bandgap circuit is based on a Schmitt trigger design with a single feedback device, and a purposely low potential on a divider being a p-channel/n-channel ratio. The POR circuit includes some hysteresis with a crossing point at a low voltage, and generates output pulses POROUT and OUTBAR as shown in FIG. 8.

The goal of the POR circuit is to insure that sufficient supply voltage is present prior to enabling critical set-up voltages and enabling the LVCS and $\Delta V_{be}$-$V_{be}$ circuitry to be biased to the desired operating state. This is because the LVCS and the $\Delta V_{be}$-$V_{be}$ circuitry both employ closed control loops. Unless there is a start-up state which provides a current path to ground, the LVCS and $\Delta V_{be}$-$V_{be}$ circuitry may not be ensured a stable turn-on state. The advantage of this POR circuit is that it is effectively removed after the supply voltage has stabilized. Also, with the POR of FIG. 8, parasitic or undesired feedback loops are not formed which could result in malfunction of the sub-bandgap circuit. Also, after completion of the power on reset sequence described below, the POR circuit assumes an "off" condition which has negligible power dissipation.

The Power On Reset (POR) circuit of FIG. 8 sets the initial condition of any needed operating nodes in the sub-bandgap circuit of FIG. 9. For example, the POR circuit is used to kick start the $\Delta V_{be}$-$V_{be}$ circuitry which operates in closed loop fashion and may therefore benefit from such a start-up mode.

Finally, FIG. 9 illustrates a schematic of a complete sub-bandgap reference circuit according to another embodiment of the invention. The schematic includes all of the circuit blocks described above, including amplifiers (FIG. 6), LVCS (FIG. 7), POR (FIG. 8), $\Delta V_{be}$-$V_{be}$ circuitry 530, and averaging circuitry 920 which includes amplifiers I11, I12, and I16 and is a variation of circuitry 320. The schematic includes the LVCS (113) which provides current reference signals Pout (sink) and Nout (source) for biasing p-channel and n-channel FETs, respectively, and a threshold-reducing well-bias signal PBODY for a p-channel FET. The schematic also includes the POR (I14) that provides a pulse in response to detecting a rising voltage at the supply node Vcc. Several amplifiers I10, I11, I12, and I16 are used, which may be amplifier A described earlier and illustrated in FIG. 6, including the control loop amplifier I10, and buffer amplifiers I11, I12, and I16. The schematic also includes exemplary dimensions for the FETs I1, I2, I0 in the unequal area current mirror of current source 310 having the ratio 1:2:8.5, respectively. When the circuit of FIG. 9 is first powered up, the POR resets nodes in the LVCS to the proper potential. Once the supply has stabilized, the LVCS is then enabled which in turn biases the amplifiers. Thereafter, the $\Delta V_{be}$ and $V_{be}$ are generated by circuitry 530 and averaged by circuitry 920 as described earlier to yield a buffered sub-bandgap reference voltage $V_{OUT}$.

The embodiments of the sub-bandgap reference described above for exemplary purposes are, of course, subject to other variations in structure and implementation. In general, the design should have low currents so that lower power is consumed, although a trade off may need to be made with lower noise immunity and slower response. Also, lower currents reduce errors due to second and higher order effects present in the generation of $K\Delta V$ and $V_{D1}$. The lower currents also yield lower current matching errors in the various current mirrors used in the overall design by lowering drain potential differences and resistive drops. Also, in all of the embodiments of the invention described above, MOSFETs are used to illustrate embodiments of the invention which may be built using a standard sub-micron CMOS fabrication processes. Other types of transistors, however, are possible and within the grasp of one skilled in the art of analog circuit design, and may be built on fabrication processes other than standard CMOS.

Therefore, the scope of the invention should be determined not by the embodiments illustrated but by the appended claims and their legal equivalents.

What is claimed is:

1. A method for generating a reference signal, comprising the steps of:

generating a first signal having a first value and a negative temperature coefficient;

generating a second signal having a second value and a positive temperature coefficient;

sampling and storing the first and second signals on first and second capacitive elements, respectively; and creating a low impedance path between the first and second capacitive elements to yield the reference signal across one of said capacitive elements.

2. The method of claim 1 wherein the step of generating a second signal comprises the second signal being related to a voltage difference between first and second diode-like elements.

3. The method of claim 1 further comprising the step of sampling the reference signal across one of said capacitive elements.

* * * * *

UNITED STATES PATENT AND TRADEMARK OFFICE

CERTIFICATE OF CORRECTION

PATENT NO. : 6,147,548
DATED : November 16, 1999
INVENTOR(S) : Doyle

It is certified that error appears in the above-identified patent and that said Letters Patent is hereby corrected as shown below:

Column 3,
Line 13, delete "modem", insert -- modern --.

Column 4,
Line 39, delete "$V_3 = mIR_2 = m\Delta V(R_2/R^1)$", insert -- $V_3 = mIR_2 = m\Delta V(R_2/R_1)$ --.

Column 8,
Line 4, delete "he", insert -- the --.

Column 11,
Line 48, delete "113", insert -- I13 --.

Signed and Sealed this

Sixth Day of August, 2002

*Attest:*

*Attesting Officer*

JAMES E. ROGAN
*Director of the United States Patent and Trademark Office*